US006352237B1

(12) United States Patent
Severino

(10) Patent No.: US 6,352,237 B1
(45) Date of Patent: Mar. 5, 2002

(54) INSULATED CONCRETE FORMING SYSTEM

(76) Inventor: Charles J. Severino, RRD2 South White Rock Rd., Holmes, NY (US) 12531

( * ) Notice: Subject to any disclaimer, the term of this patent is extended or adjusted under 35 U.S.C. 154(b) by 0 days.

(21) Appl. No.: 09/433,424

(22) Filed: Nov. 4, 1999

Related U.S. Application Data

(63) Continuation-in-part of application No. 09/368,747, filed on Aug. 5, 1999.

(51) Int. Cl.[7] ..... E04G 17/06; E04G 11/06; E04B 2/86

(52) U.S. Cl. ..... 249/194; 249/44; 249/216; 52/426

(58) Field of Search ..... 52/275, 272, 279, 52/562, 568, 565, 426, 442; 249/38, 40, 44, 45, 47, 194, 216

(56) References Cited

U.S. PATENT DOCUMENTS

| | | | | | |
|---|---|---|---|---|---|
| 813,253 | A | * | 2/1906 | Sullivan | 249/45 |
| 1,924,724 | A | | 8/1933 | Olney | |
| 3,788,020 | A | | 1/1974 | Gregori | |
| 3,985,329 | A | | 10/1976 | Liedgens | |
| 4,655,014 | A | | 4/1987 | Krecke | |
| 4,706,429 | A | | 11/1987 | Young | |
| 4,730,422 | A | | 3/1988 | Young | |
| 4,765,109 | A | | 8/1988 | Boeshart | |
| 5,065,561 | A | | 11/1991 | Mason | |
| 5,896,714 | A | * | 4/1999 | Cymbala et al. | 52/426 |
| 5,992,114 | A | * | 11/1999 | Zelinsky et al. | 249/38 |

FOREIGN PATENT DOCUMENTS

| | | | | |
|---|---|---|---|---|
| CA | 658328 | * | 2/1963 | 52/275 |

* cited by examiner

*Primary Examiner*—Michael Safavi
(74) *Attorney, Agent, or Firm*—Handal & Morofsky

(57) ABSTRACT

Structures for securing foam panels in position with respect to each other in order to form a mold for the pouring of concrete, such as in the case of the pouring of a building foundation or building wall are disclosed. A first type of member which has pairs of facing flanges for engaging facing walls at opposite ends on the member. This first type of member comprises an upper and a lower section. The upper and the lower section are connected to each other by at least one frangible bridge, which may be broken to accommodate the need for a shorter member at the top and bottom of the mold. A corner brace, having two pairs of facing flange members located in its upper section, and two pairs of facing flange members located in its lower section, is adapted to engage the four panel corners which meet at the corner of the poured cement mold where the top of one row of panels meets the bottom of the next row of panels.

9 Claims, 16 Drawing Sheets

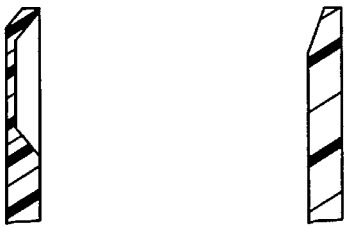
Figure 11
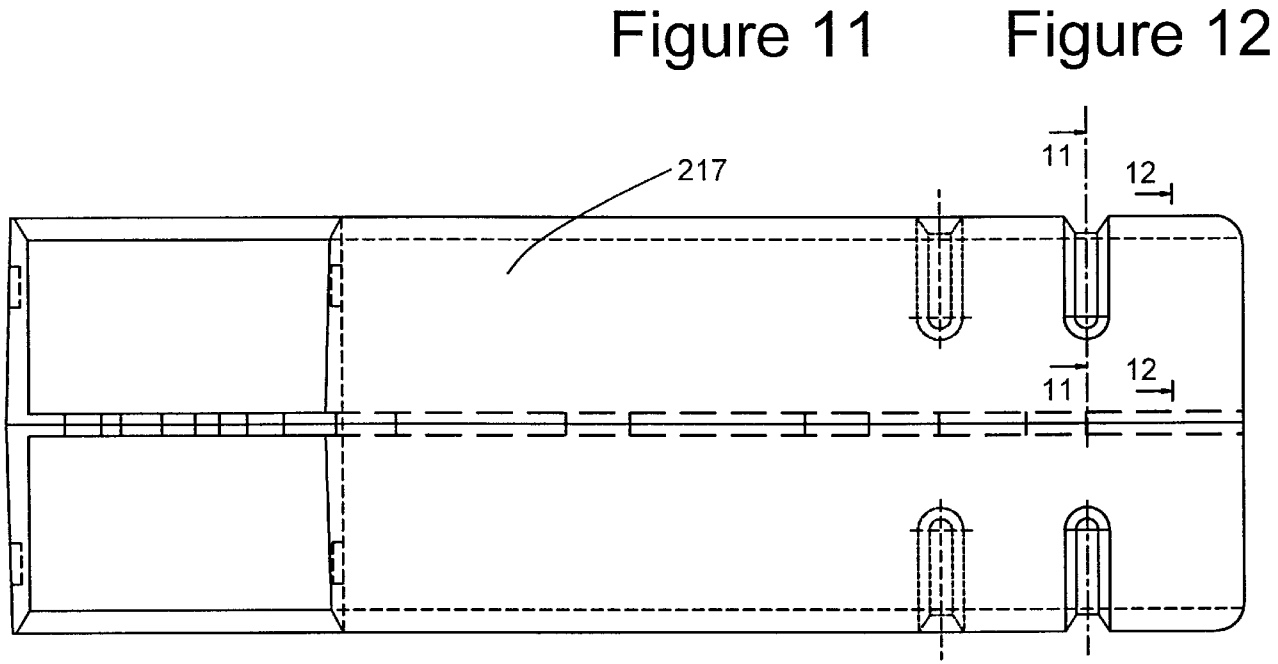
Figure 12
Figure 10

INSULATED CONCRETE FORMING SYSTEM

CROSS-REFERENCE TO RELATED APPLICATIONS

This application is a continuation-in-part of copending U.S. patent application Ser. No. 09/368,747 of Charles SEVERINO, filed Aug. 5, 1999 and entitled "INSULATED CONCRETE FORMING SYSTEM." The disclosure of the aforementioned United States patent application is hereby incorporated herein by reference thereto.

STATEMENT REGARDING FEDERALLY SPONSORED RESEARCH OR DEVELOPMENT (Not applicable.)

BACKGROUND OF THE INVENTION

1. Field of the Invention

The present invention relates to an insulated concrete forming system, more particularly to a system of supports that maintains forms in a desired spacial relationship between which concrete is poured.

2. Description of Related Art Including Information Disclosed Under 37 CFR 1.97 and 37 CFR 1.98

Typical wall-forming systems employ "blocks", which work as a pair of panels spaced apart by a system of "ties" and are stacked to form a wall of the desired height. The panels can be made of wood or some other material. More effective systems utilize panels of lighter weight materials such as polystyrene. The ties which hold the panels in the predetermined spatial relationship have typically been dowels of fixed length inserted from the outside of the panels through the form and perpendicular to the plane of the panels. These dowels have usually been expensive steel rods which are costly to transport. In an effort to reduce the cost of transportation such ties have been manufactured from lightweight plastics. However, such plastic ties, while they do address certain cost issues, are not without problems.

Another problem with the plastic tie of the prior art is that ties placed at the top and/or bottom of the form protrude above or below the form and have to be cut. Alternatively, no ties may be used or a half tie could be placed at the top or bottom of the form, thus eliminating the need for cutting any tie at the top of the form. However, this involves manufacture transport and stocking of the ties. The absence of ties at the top and bottom of the form, however, results in structural instability and reduced strength of the form and can pose a safety threat to workers while concrete is being poured.

A further problem with the tie of the prior art is that they are flimsy and composed of two or more parts. Ties which are very narrow and thin do not lend much to the structural integrity of the concrete form, and ties which are composed of a plurality of pieces may separate and weaken the form while concrete is being poured into it.

It is therefore a general object of the present invention to provide an improved tie of a single length and height which can be used to form panel walls of varying heights, while providing for the strength and stability of forms stabilized by top and bottom tie without the need for specialized top and bottom ties or foam panels with dedicated middle or top and bottom elements.

It is also an object of the present invention to provide a tie which can be used to hold the uppermost and bottommost portions of the panels together in order to maintain the structural integrity of the form while concrete is being poured into it.

It is a further object of the invention to provide a tie formed from a single piece of plastic to eliminate the chance of a tie separating while it is being subjected to the stresses of concrete being poured into the form.

SUMMARY OF THE INVENTION

The present invention is drawn to a device for interlocking form panels. It contemplates an elongated member that is substantially planar and having first and second sections connected by frangible bridges. First and second sections each have first and second ends. First and second flange members are attached to the ends and diverge from the elongated member. These flange members are also substantially planar, parallel to each other and protrude perpendicularly out of the plane of the elongated member an equal distance from the first and second sides of the elongated member.

A first pair of guide rib member is attached to the elongated member at a point near the first end of the elongated member, is in a parallel planar relationship with the first diverging flange member, and protrudes perpendicularly from the first side of the elongated member. The first pair of guide rib member is attached at a point from the first diverging flange member so as to define a distance that is substantially equal to the thickness of a form panel.

A second pair of guide rib members is attached to the elongated member at a point near the second end of the elongated member, is in a parallel planar relationship with the second diverging flange member, and protrudes perpendicularly from the second side of the elongated member. This pair of guide rib members is attached at a point from the second diverging flange member so as to define a distance that is substantially equal to the thickness of a form panel.

A frangible bridge separates the top half of the elongated member from the bottom half of the elongated member and is positioned along the longitudinal axis of the elongated member. The top half of the elongated member is coplanar with the bottom half of the elongated member.

Another embodiment of the tie contemplates a third pair of guide rib members protruding horizontally out of the second side of the elongated member and configured, positioned, and dimensioned so as to be in a parallel planar relationship with the first pair of diverging flange members and to define a distance between the first pair of diverging flange members and the third pair of guide rib members that is equal to the thickness of a form panel. This embodiment also contemplates a fourth pair of guide rib members protruding perpendicularly out of the first side of the elongated member at points equal and distal from the second pair of diverging flange members and being configured, positioned, and dimensioned so as to be in a parallel planar relationship with the second pair of diverging flange members and to define a distance between the second pair of diverging flange members and the fourth pair of guide rib members that is equal to the thickness of a form panel.

Still another embodiment of the invention contemplates a clip for holding rebar in place protruding perpendicularly outward from the first section of the elongated member in a coplanar configuration with the elongated member at a point intermediate the first and second pairs of diverging flange members. A second clip for holding rebar in place similarly protrudes perpendicularly outward from the second section of the elongated member. A plurality of clips for holding rebar may be used.

Yet another embodiment of the invention contemplates a void or a plurality of voids formed in the elongated member through which concrete can flow.

The invention can be fabricated from a variety of plastic materials, a lightweight metal, or other suitable material.

BRIEF DESCRIPTION OF THE DRAWINGS

FIG. 10 is a plan view of the inventive corner brace illustrated in FIG. 9 along line 10—10 of FIG. 9;

FIG. 11 is a plan view of the inventive corner brace illustrated in FIG. 9 along line 11—11 of FIG. 10;

FIG. 12 is a plan view of the inventive corner brace illustrated in FIG. 9 along line 12—12 of FIG. 10;

DETAILED DESCRIPTION OF THE PREFERRED EMBODIMENTS

Figure 1:
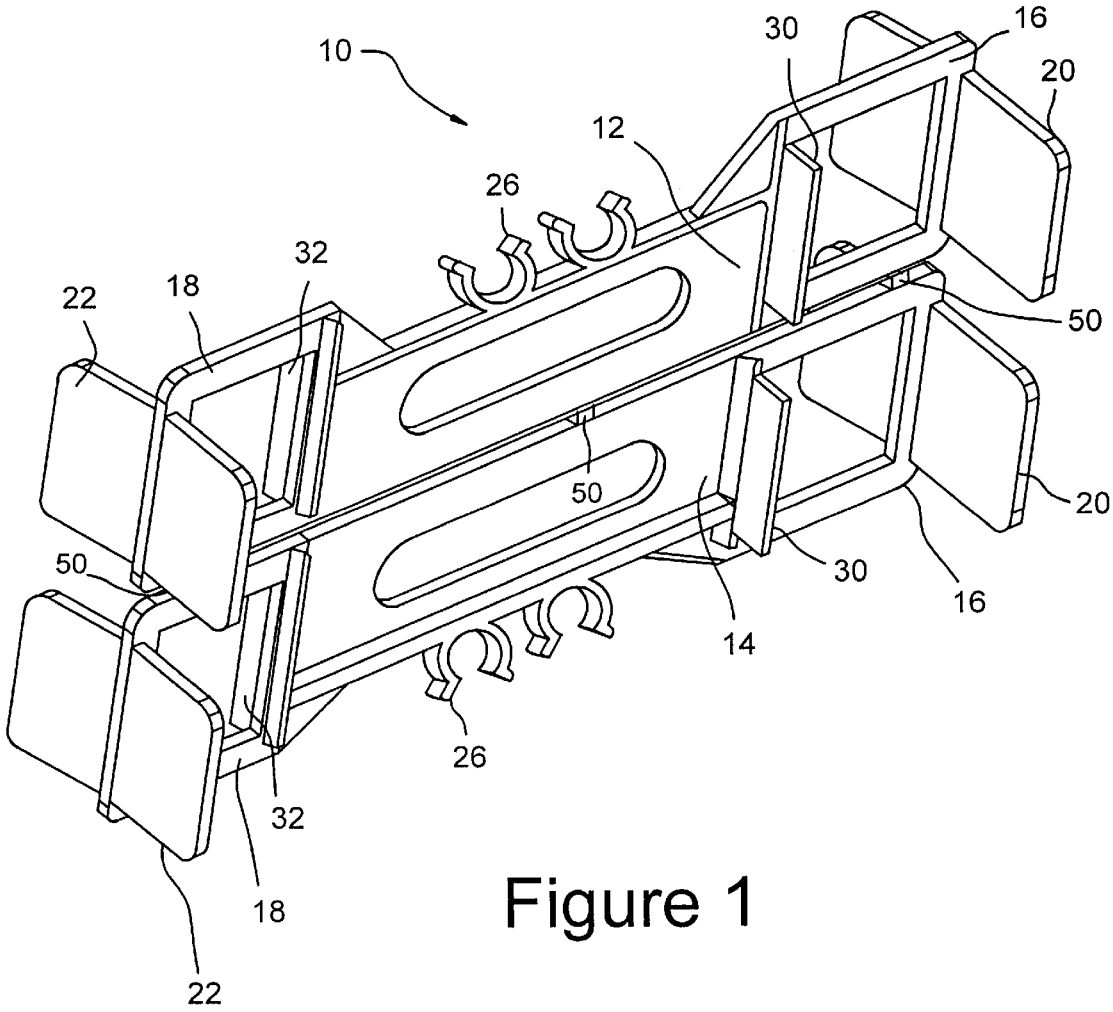
FIG. 1 is a planar view of the inventive tie having two pairs of guide ribs, a plurality of clips for holding cement reinforcing metal bars or "rebar" in place, with provision for separating the top half of the tie from the bottom half.

Referring to FIG. 1, a tie 10 constructed in accordance with the present invention is illustrated. Tie 10 is constructed out of a flexible polymer, a plastic, or a lightweight metal such as aluminum. In accordance with the preferred embodiment of the invention, tie 10 is injection molded from a tough resilient plastic, such as polystyrene.

Tie 10 comprises a first upper section 12 and a second lower section 14. First section 12 and second section 14 have first ends 16 and second ends 18. First section 12 and second section 14 are joined by narrow frangible bridges 50. Frangible bridges 50 can be broken or cut allowing first section 12 to be separated from second section 14.

Figure 2:
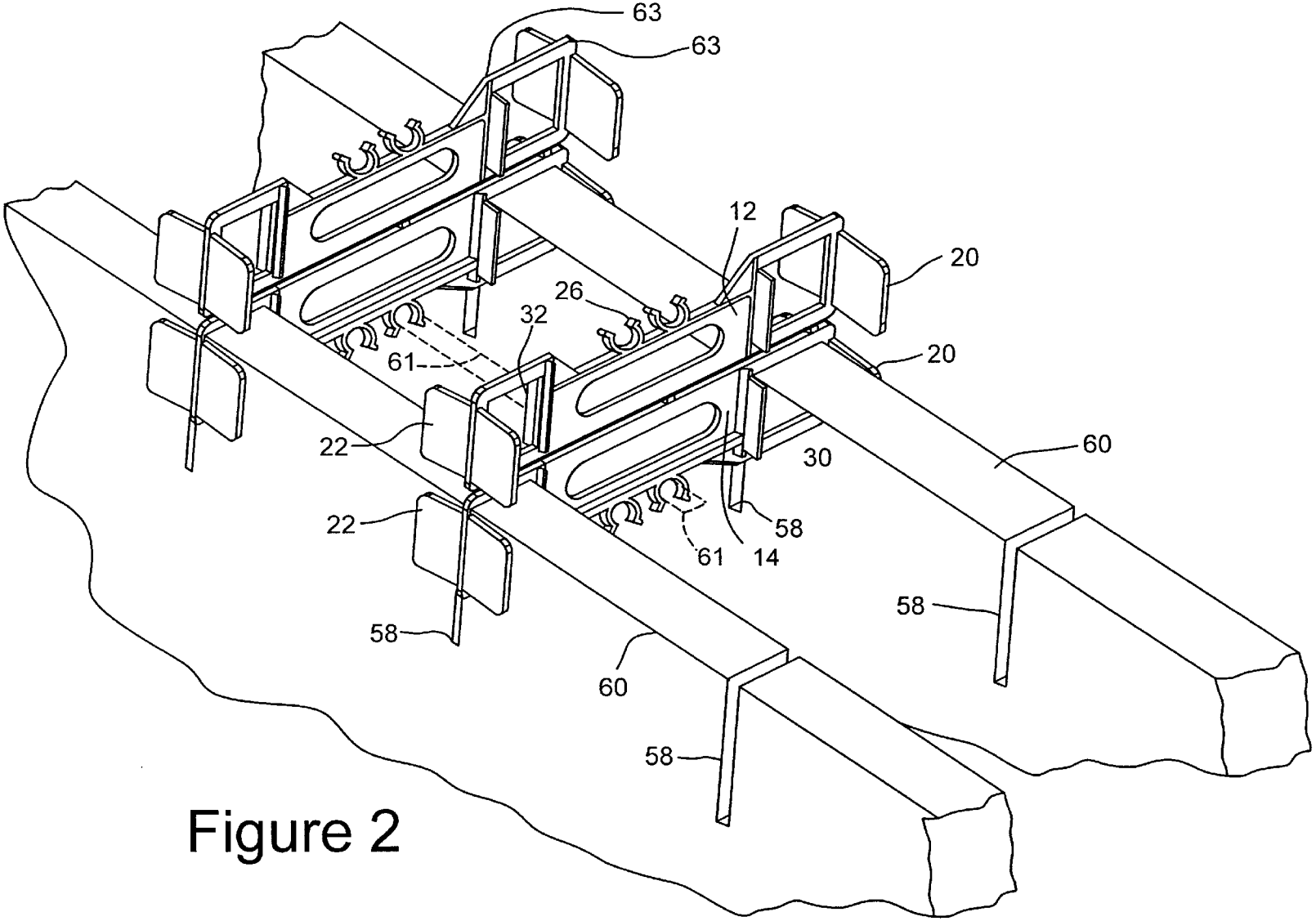
FIG. 2 is a planar view of the tie system showing two ties as they are positioned between form panels prior to the pouring of concrete into the form.

Generally, ties 10 are placed and may be used to form a form for pouring cement, as illustrated in FIG. 2. As can be seen in the figure, a form is formed by a pair of spaced and facing panels 60 (usually made of expanded modified polystyrene). During use, concrete reinforcing bars 61 are placed in clips 26 in the ties 10, and concrete is poured between the panels 60. After the concrete hardens, the form panels 60 may be removed, leaving behind a concrete wall. Alternately, form panels 60 may be left on the concrete wall to serve as insulation or a base for another type of finish. If the form panels 60 are removed, protruding portions 63 of ties 10 can be broken off and removed befor finishing the concrete wall.

Figure 3:
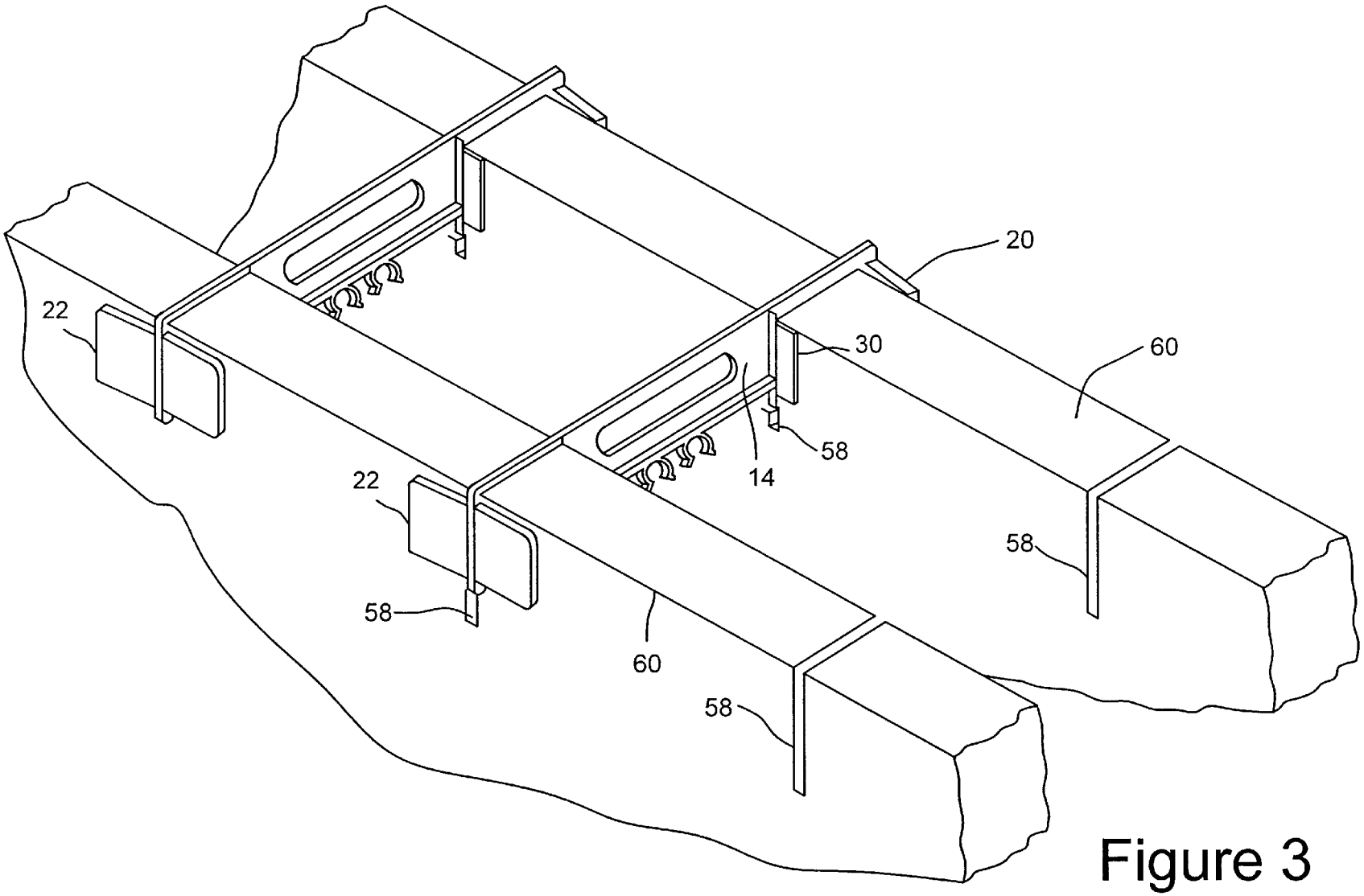
FIG. 3 is a planar view of the tie system showing two ties as they are positioned between form panels and at the top edge of the form panels prior to the pouring of concrete into the form.

As can be understood from FIG. 3, in addition, in accordance with the preferred embodiment, a particularly advantageous mode of use is achieved with respect to the bottom and top of the mold. In particular, first section 12 or second section 14 can be inserted into a top or bottom transverse slot 58 of form panel 60 in such a manner so as to not protrude above the top or below the bottom edge of form panel 60. Such an arrangement showing the use of a half-tie at the top of a mold is illustrated in FIG. 3.

First sections 12 and second sections 14 are configured to receive, support, and maintained in a spaced configuration a pair of form boards 60. On the first ends 16 of both first section 12 and second section 14 are disposed a first pair of diverging flange members 20. Diverging flange members 20 are positioned, configured, and dimensioned to project perpendicularly outward from the planes of first section 12 and second section 14. A second pair of diverging flange members 22 is disposed on the second ends 18 of both first section 12 and second section 14 and project similarly outward from the planes of first section 12 and second section 14. Diverging flange members 20 and 22 provide better support to form panels 60 against the stresses incurred by the pouring of wet concrete.

First ends 16 of first section 12 and second section 14 have disposed on them a first pair of guide rib members 30 at points distal from the diverging flange members 20. The distance between the first pair of guide rib members 30 and diverging flange members 20 defines the thickness of form panel 60. Guide rib members 30 perpendicularly protrude from one side of first section 12 and second section 14 outward and in such a manner so as to be in a parallel planar relationship with diverging flange members 20.

Second ends 18 of first section 12 and second section 14 have disposed on them a second pair of guide rib members 32 at points distal from the diverging flange members 22. The distance between the second pair of guide rib members 32 and diverging flange members 22 also defines the thickness of form panel 60. Second pair of guide rib members 32 protrudes from the opposite side from which first pair of guide rib members 30 protrude. Second pair of guide rib members 32 protrudes from first section 12 and second section 14, perpendicularly outward and in such a manner so as to be in a parallel planar relationship with diverging flange members 22.

Clips 26 for holding rebar in place protrude from the top edge of first section 12 and bottom edge of second section 14. Clips 26 are molded as part of both first section 12 and second section 14 if tie 10 is plastic. Alternately, clips 26 are cast as part of both first section 12 and second section 14, if tie 10 is made of metal. Clips 26 consist of two curved prongs which protrude away from the first section 12 and second section 14 in an arcing fashion. The arcing prongs are situated and configured in such a manner that the concave portions of each arcing prong face each other. Furthermore, the arcing prongs conform substantially to the radius of the cross section of the rebar. Arcing prongs are constructed so as to be flexible. The prongs can be spread apart when rebar is forced part way between them and can clip around and hold rebar firmly when the rebar is forced all the way between them. A plurality of clips 26 can be molded or cast into each first section 12 and second section 14.

FIG. 2 is a planar view of two ties 10 inserted into slots 58 in two form panels. Ties 10 are positioned in a row of slots 58 evenly spaced in the top and bottom edges of form panels 60 on one side and in a corresponding row of equally spaced slots 58 in form panels 60 on the opposite side. Form panels 60 are typically constructed of polystyrene or a similar deformable material. Alternately, form panels 60 may also be constructed of wood. It is contemplated that the in the case of form panels 60 being made of wood, the panels 60 may be reused.

Figure 4:
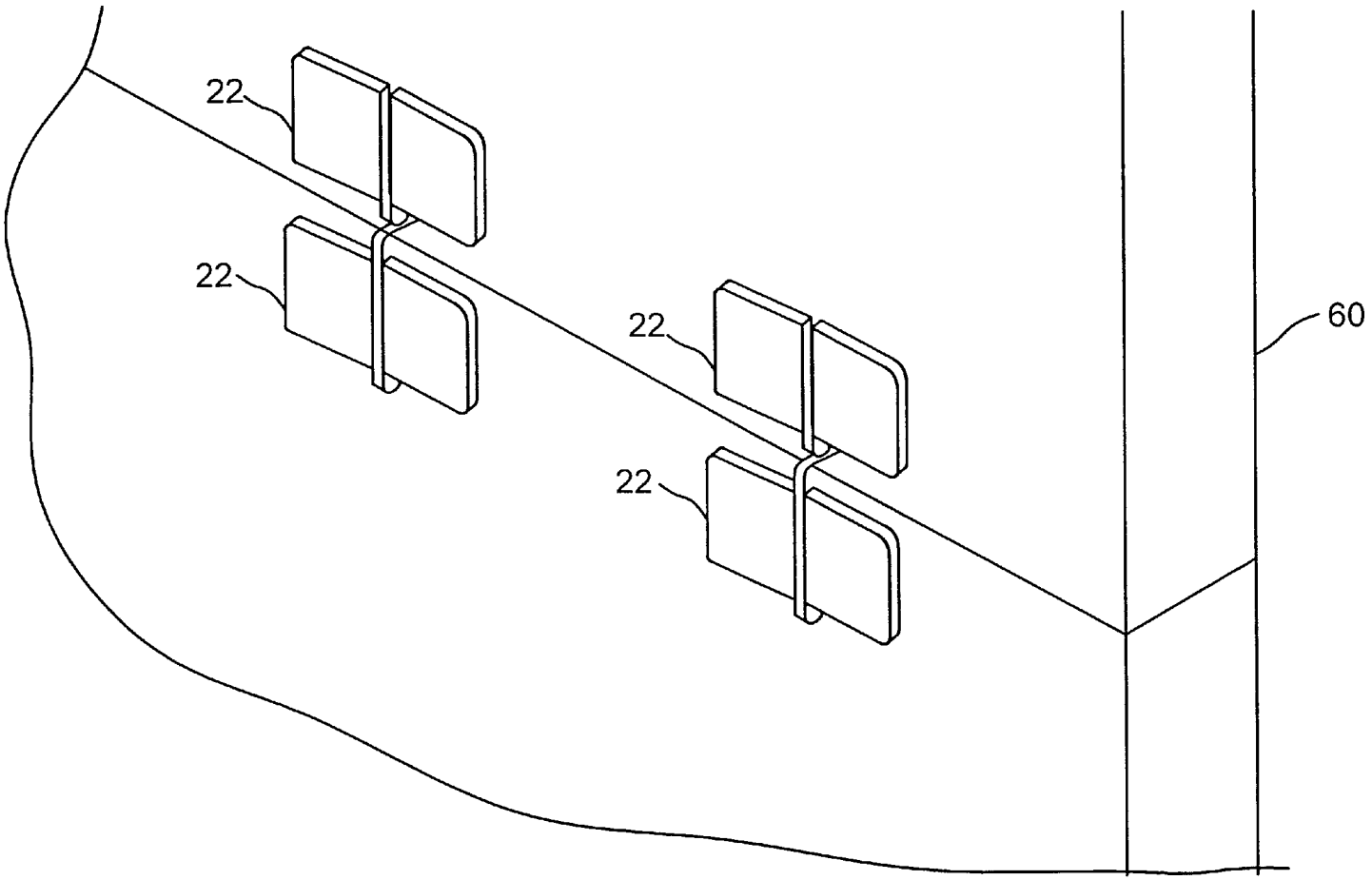
FIG. 4 is a planar view of the tie system showing two ties at the interface of two form panels.

The height of the ties 10 is approximately twice the depth of the slots 58 of form panels 60, so that half of each of the ties fits into a slot 58 in the form panel 60 below while the other half fits into a slot 58 in the form panel 60 above, thereby causing ties 10 to straddle the interfaces between horizontal edges of upper and lower form panels 60, as illustrated in FIG. 4.

Second section 14 is inserted into the slots 58 of form panels in such a manner so as one form panel is held between diverging flange member 20 and guide rib 30 on second section 14 of tie 10. Likewise, another form panel is held between diverging flange member 22 and guide rib 32 on second section 14 of tie 10. Once two form panels 60 are adequately linked together at their tops using a number of ties 10 that correspond to the number of slots 58 in the forms panels 60, additional form panels 60 may be placed on top of the linked form panels 60 and held together by the first sections 12 of ties 10. In this manner, the form panels can be stacked to a height that meets the specification of the concrete wall to be built.

Figure 5:
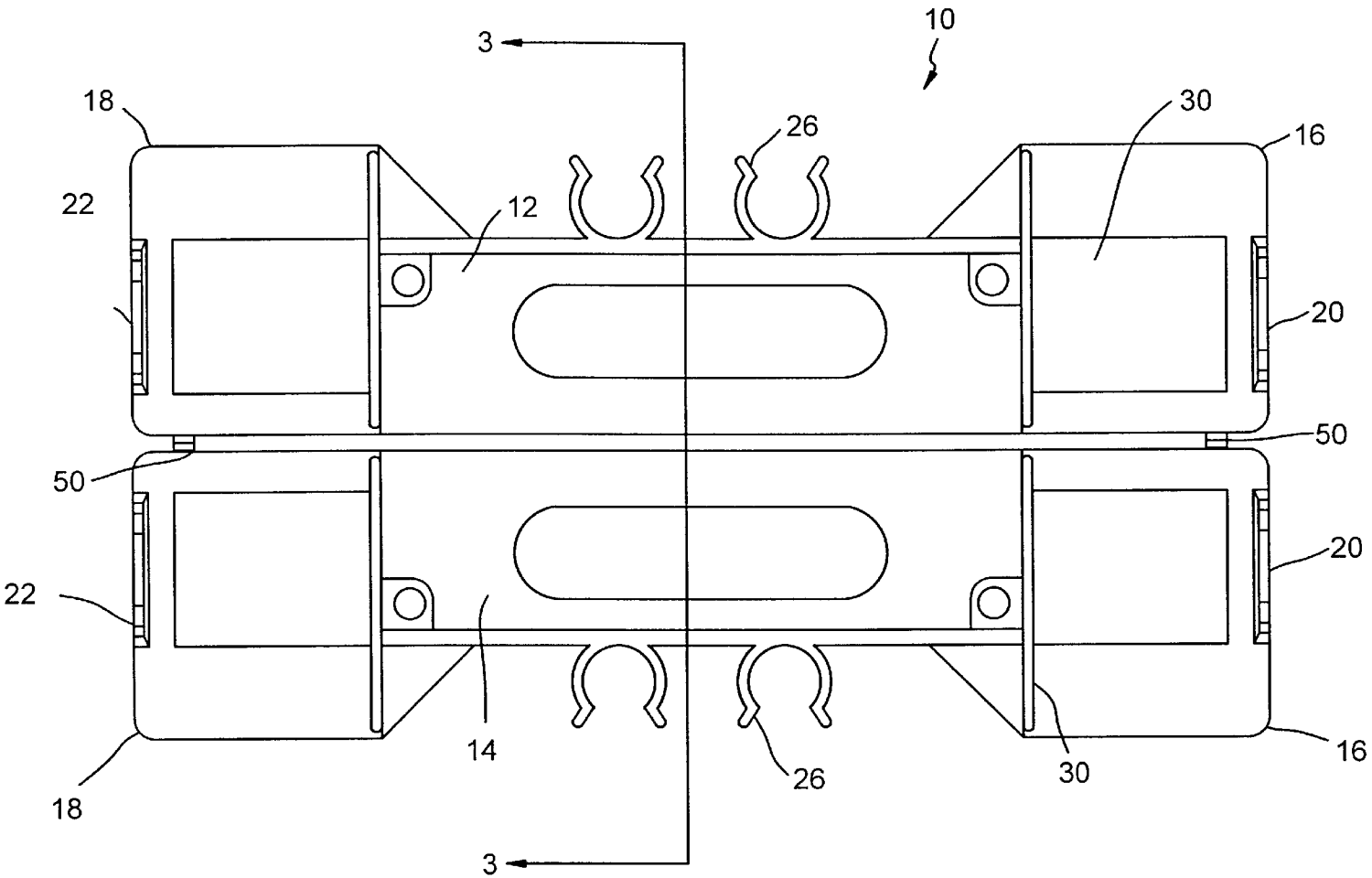
FIG. 5 is a side view of the tie showing two pairs of guide ribs, and a plurality of clips for holding rebar in place.

FIG. 5 is a side view of tie 10. Separating the first section 12 from the second section 14 in order to use half of the tie 10 at the top or bottom of a form panel involves cutting frangible bridges 50.

Figure 6:
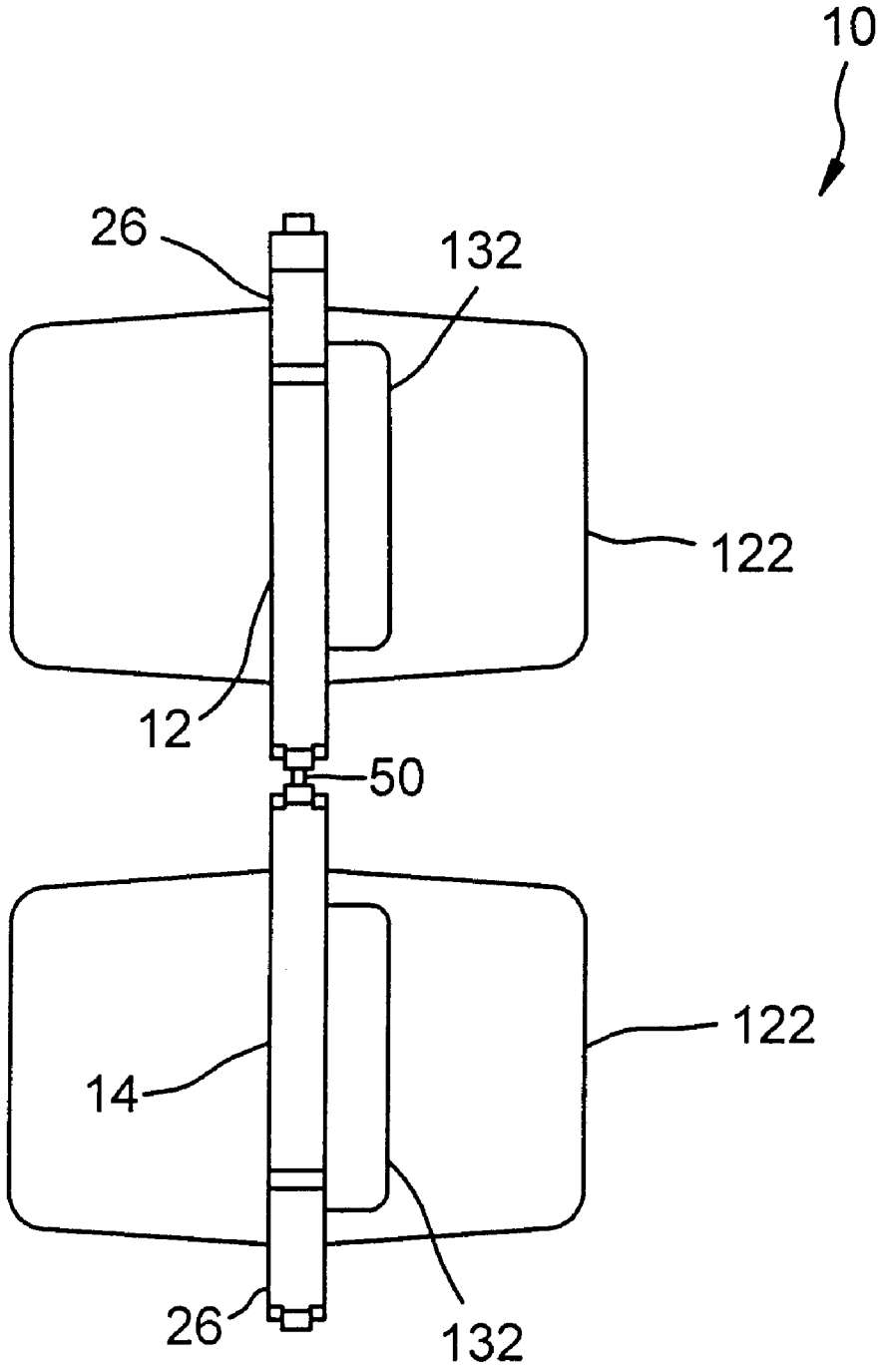
FIG. 6 is an end view of the tie along line 3—3 of FIG. 5.

FIG. 6 shows an end view illustration of tie 10 along the line 3—3 of FIG. 5. Second pair of guide rib members 32 is shown on the second end of tie 10. Frangible bridge 50 is also illustrated.

In FIG. 1, only two pairs of guide rib members are shown. Each are located on opposing sides of tie 10. However, referring now to FIG. 7, another embodiment of the tie is disclosed. Tie 110 has two additional pairs of guide rib members attached to first section 112 and second section 114 of tie 110. A third pair of guide rib members 134 is disposed on the first end of tie 110 at points distal from diverging flange members 120 and opposite the first pair of guide rib members 130.

Third pair of guide rib members 134 protrudes from first section 112 and second section 114 perpendicularly outward from the plane of tie 110 and in the opposite direction from first pair of guide rib members 130. In a similar manner fourth pair of guide rib members 136 is situated on the second end of tie 110 distal from diverging flange member 122 and protrudes perpendicularly outward from the plane of tie 110 and in the opposite direction from second pair of guide rib members 132.

The distance between the first pair of guide rib members 130 and diverging flange member 120, as well as the distance between third pair of guide rib members 134 and diverging flange member 120, defines the thickness of a form panel situated on the first end 116 of tie 110 and placed so as to form one side of a wall. Likewise, the distance between the second pair of guide rib members 132 and diverging flange member 122, as well as the distance between fourth pair of guide rib members 136 and diverging flange member 122, defines the thickness of a form panel situated on the second end 118 of tie 110 and forms the second side of a wall. The volume defined between the two form panels, which is partially occupied by the tie 110, is where concrete is poured to form the wall.

Figure 7:
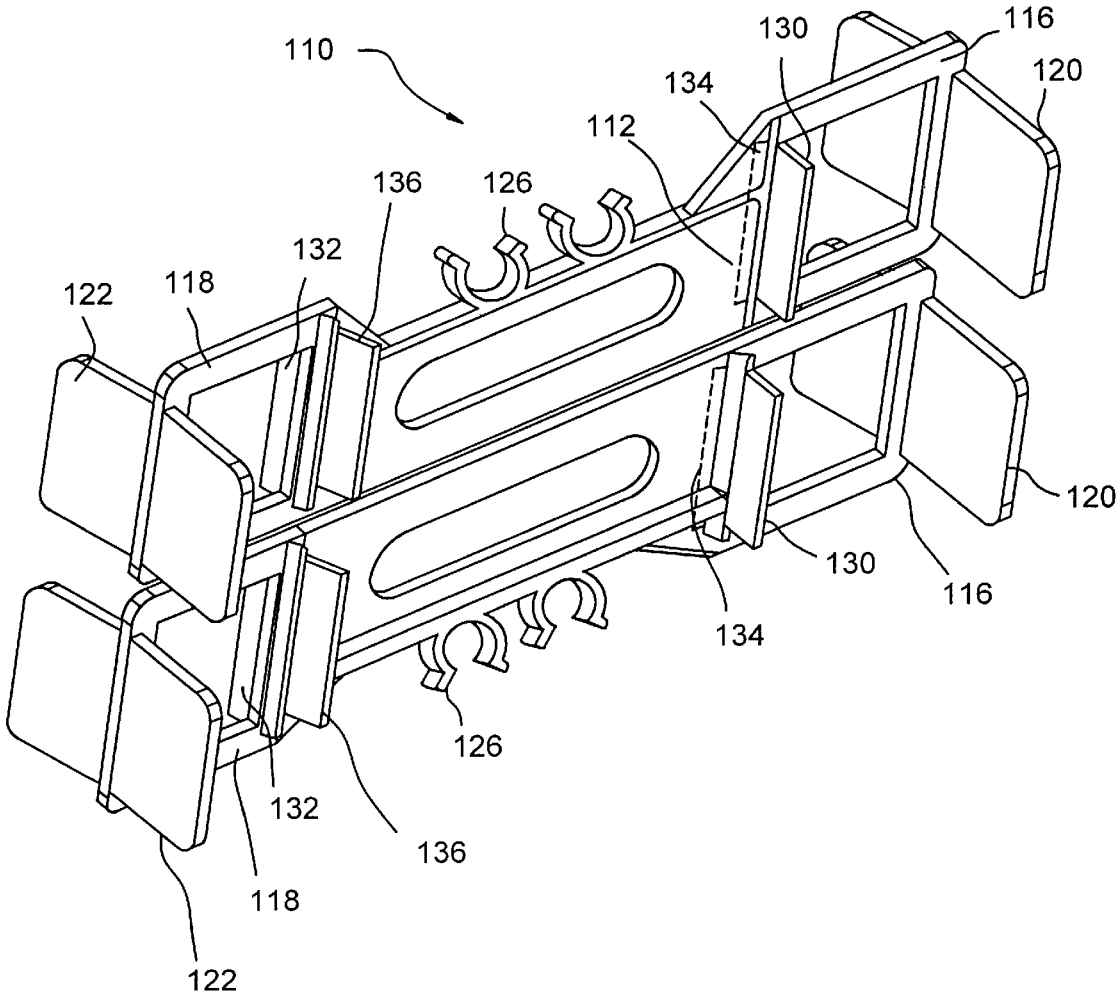
FIG. 7 is a planar view of the tie showing four pairs of guide ribs and a plurality of clips for holding rebar in place.
Figure 8:
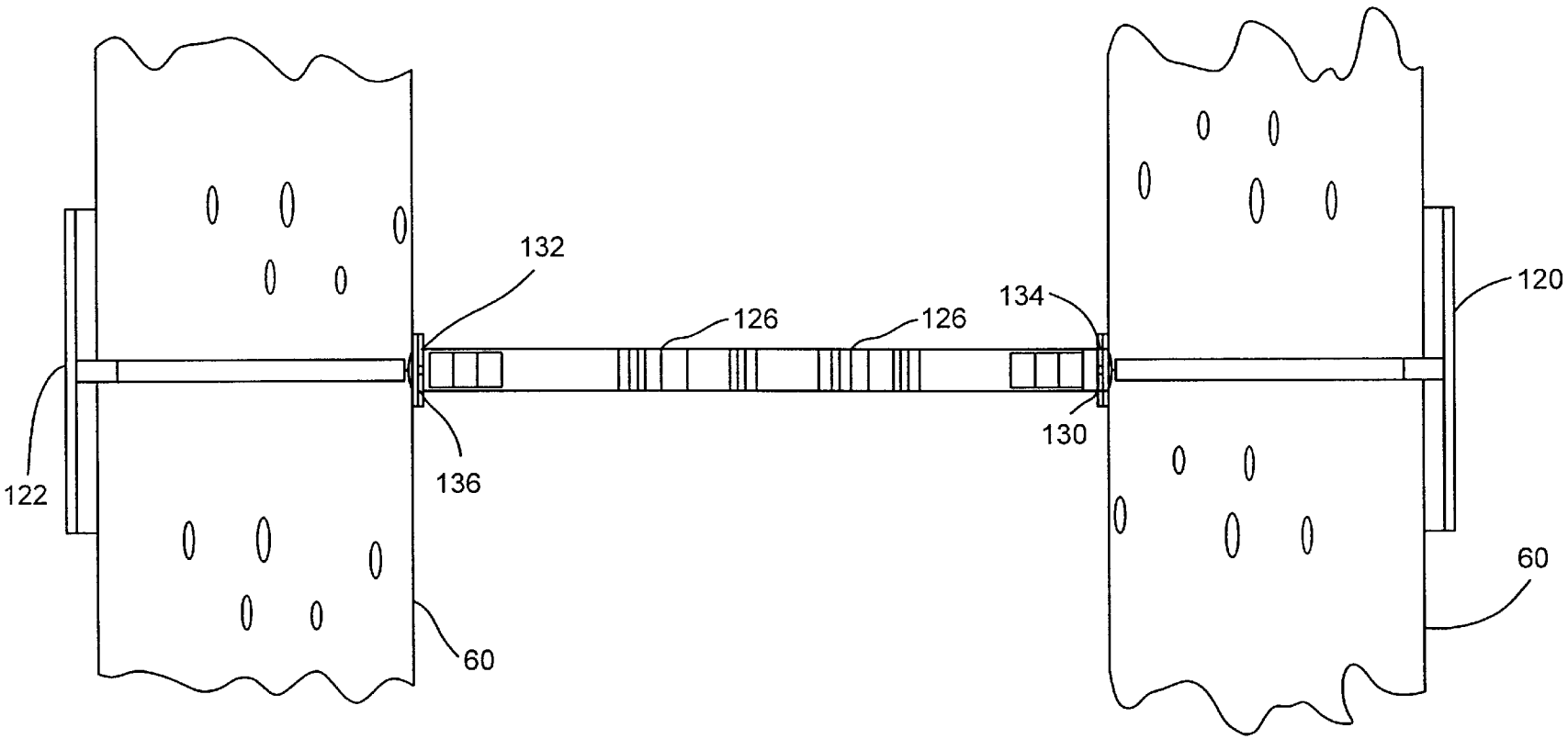
FIG. 8 is a top view of a tie having four pairs of guide ribs as it would be employed in a form panel system.

FIG. 8 is an illustration of the top view of tie 110 of FIG. 7 as it would be employed in a wall form system. Guide ribs 130 and 134 serve to hold form panel 60 against diverging flange members 120, while guide ribs 132 and 136 serve to hold form panel 20 against diverging flange members 122.

The system described above gives an unprecedented degree of stability during the pouring of concrete. However, yet additional stability can be achieved through the additional use of corner braces of the type illustrated in FIGS. 9 through 15 to construct a form such as that illustrated in FIG. 16.

Figure 9:
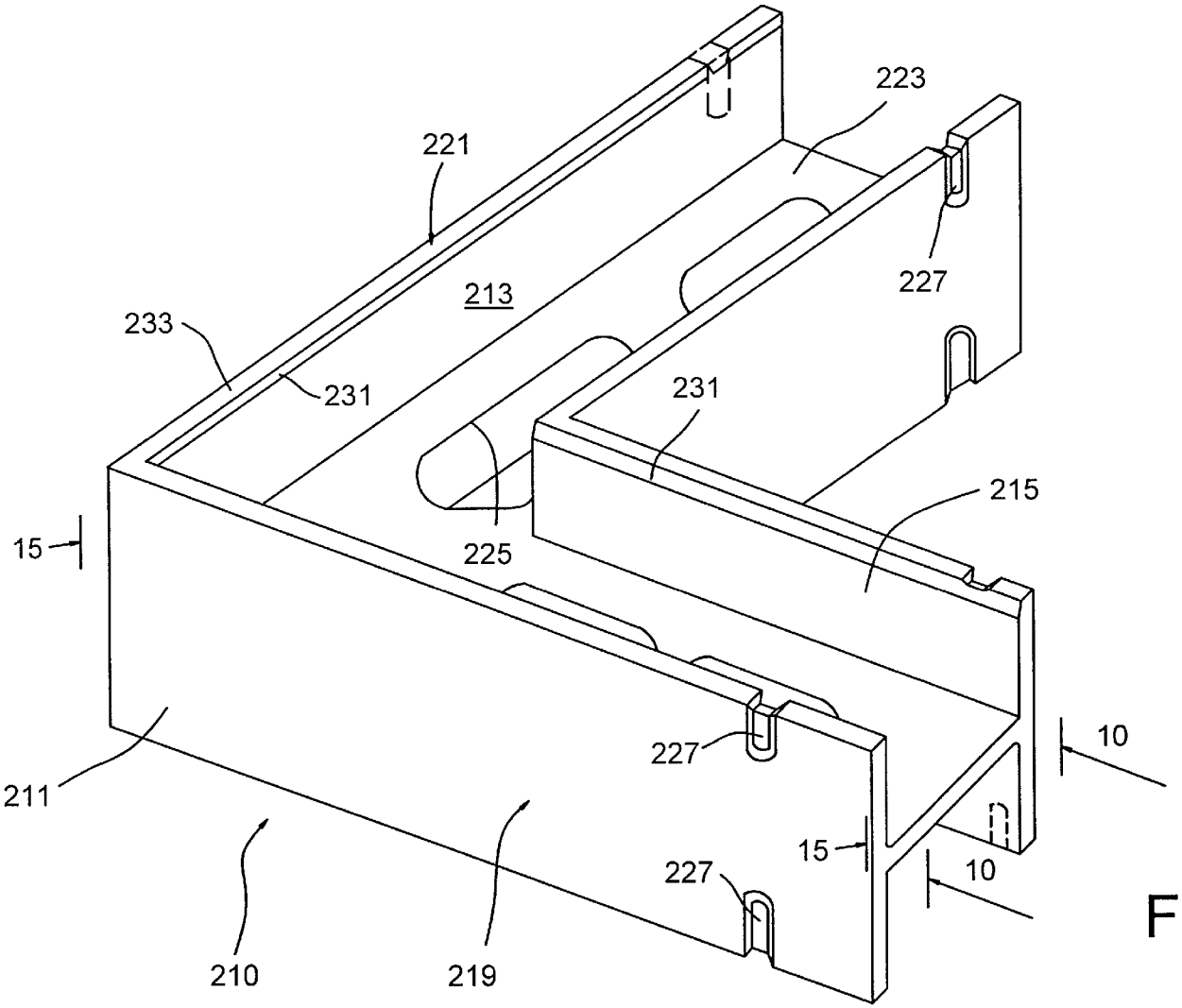
FIG. 9 is an isometric view of the inventive corner brace for employment of the method of the present invention.

Referring first to FIG. 9, a corner brace 210 constructed in accordance with the present invention is illustrated. Comer brace 210 includes a first long side wall 211 and the second long side wall 213. Corner brace 210 also includes a first short side wall 215 to the second short side wall 217. Comer brace 210 thus defines a pair of legs 219 and 221. The structural integrity of the system is maintained by L-shaped crosspiece 223, which has a plurality of holes 225 disposed in it.

Holes 225 are provided for the purpose of reducing the consumption of materials.

Elongated thin regions 227 are provided to receive screws. Regions 227 are elongated in order to allow the screws to be fastened at a plurality of positions which are selectable by the user. This is of importance for firmly securing the foam and because, in accordance with the preferred embodiment, it is contemplated that plywood, sheet rock or other material will be fastened to the sides of the concrete wall after it has been cast. The use of elongated screw-receiving regions 227 allows the person to accommodate unpredictability in the positions of the edges of the sheet rock or other similar material.

Figure 13:
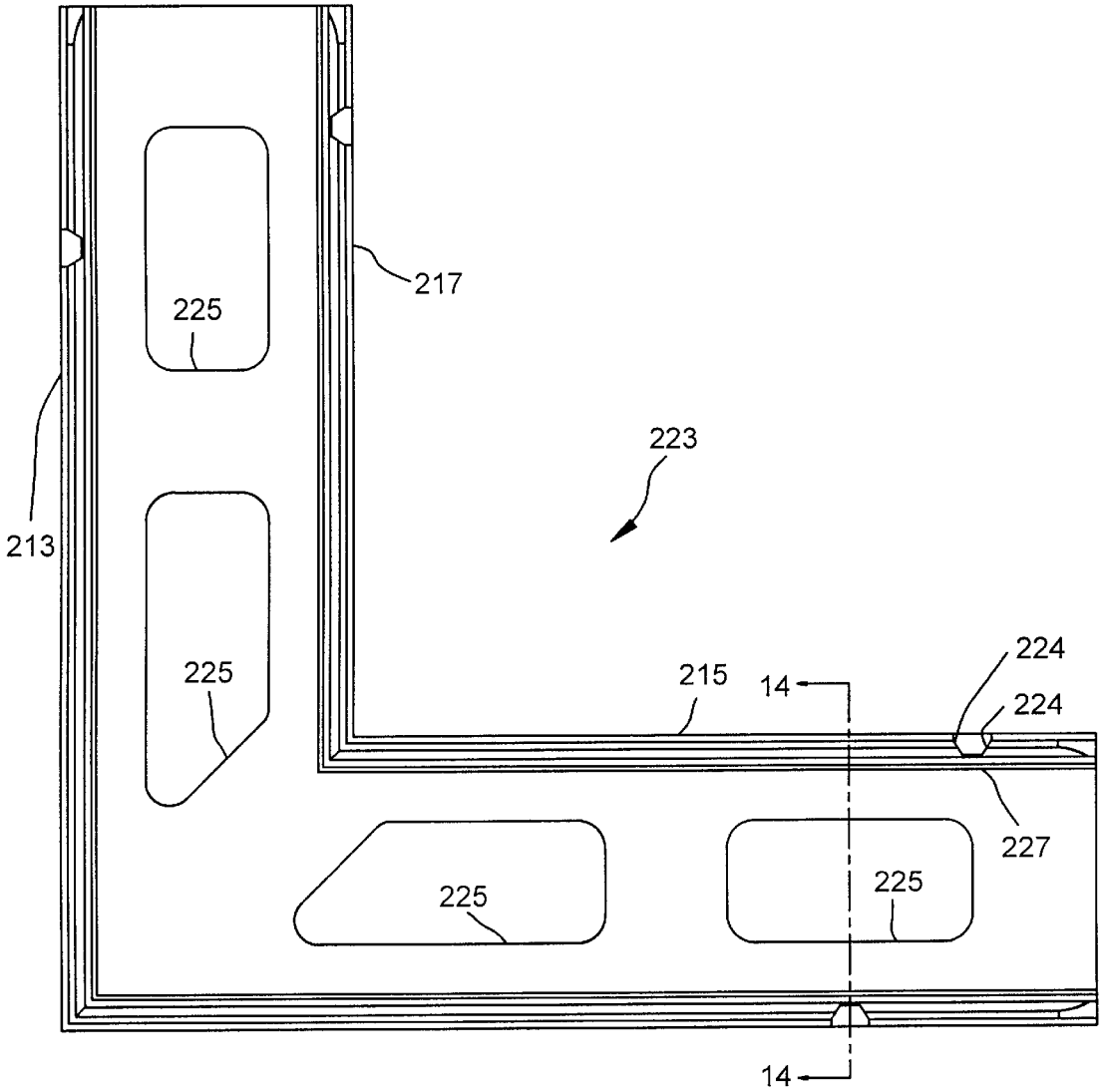
FIG. 13 is a top plan view of the inventive corner brace illustrated in FIG. 9.

As shown most clearly in FIG. 13, elongated regions 227 are defined between two slanted elongated surfaces 229. Elongated surfaces 229 are slanted to match the angular slant of the screw used to secure the tie in place.

Figure 14:
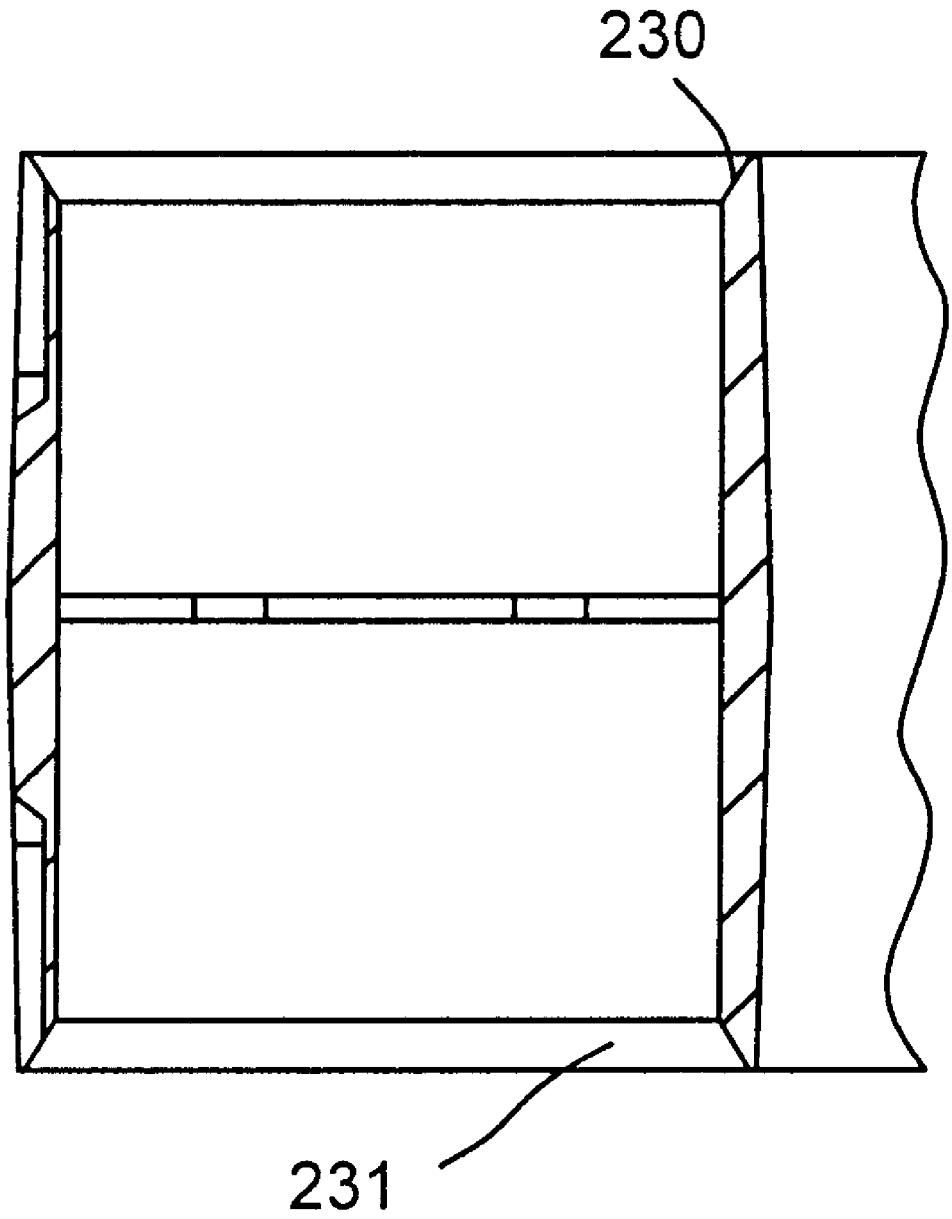
FIG. 14 is a cross-sectional view of the inventive corner brace illustrated in FIG. 9 along line 14—14 of FIG. 13.
Figure 15:
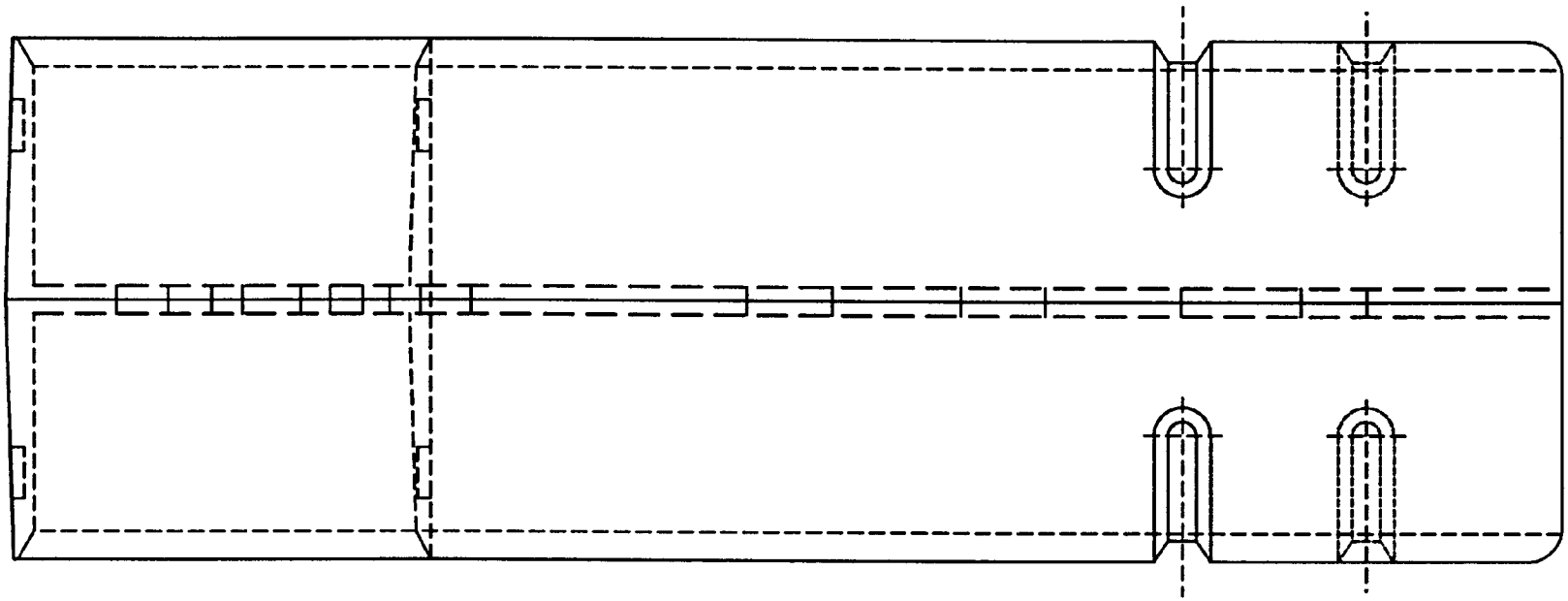
FIG. 15 is a plan view of the view of the inventive corner brace illustrated in FIG. 9 along line 15—15 of FIG. 9.

As illustrated most clearly in FIG. 14, the side walls are provided with slanted guide surfaces 231 which extend from the top surfaces 233 to the main body of the side walls. The purpose of guide surfaces 231 is to make it easy to insert stunt fitting panels 260 into the corner brace as illustrated in FIG. 16.

Figure 16:
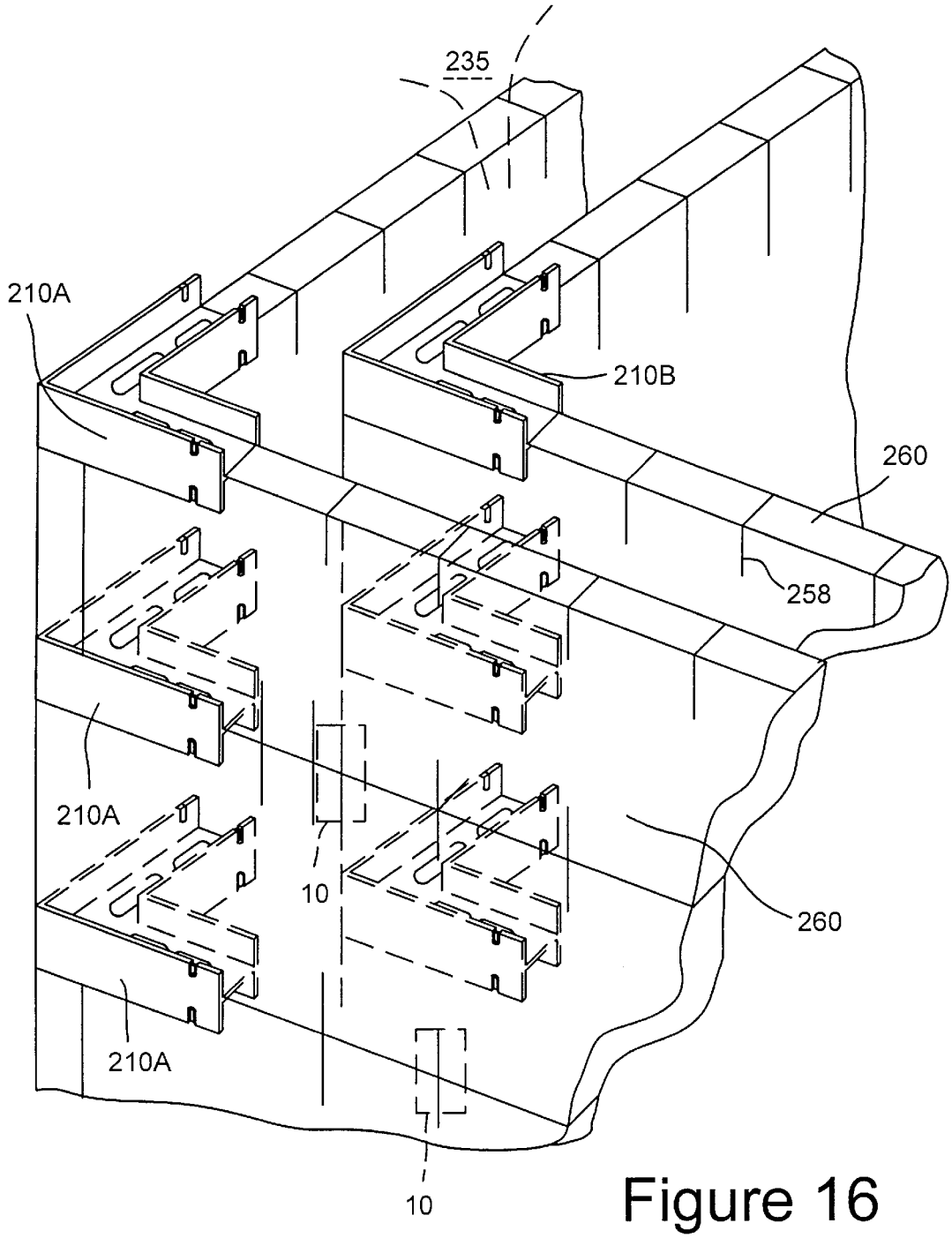
FIG. 16 is an isometric view of a form for forming a concrete wall corner using the inventive corner brace in accordance with the method of the present invention.

As is illustrated in FIG. 16, a plurality of corner braces 210*a* are positioned on the outside corner of the wall, while a plurality of braces 210*b* are positioned on the inside of the corner to define a concrete wall mold.

During use, panels 260 are laid out on the top of the first tier and penetrates from one tier to the next. Panels 260 are kept in position using half of one of the crosspieces illustrated in FIGS. 1 through 8. The same is not illustrated in FIG. 16 for the purpose of clarity of illustration, and, accordingly, slots 258 are visible in this figure.

After the first tier has been laid, the crosspiece illustrated in FIGS. 1–8 is mounted in each of the slots 258 and a corner brace 210 is put at each of the corners. The concrete form is then ready to receive another layer of panels 260, and the crosspieces and corner braces are again put in position until the last layer has been laid and the structure is completed with half crosspieces and corner braces, as illustrated in FIG. 16. For purposes of illustration, a fuel of the crosspieces 10 have been illustrated in FIG. 16 in phantom lines.

After the form has been completed as illustrated in FIG. 16, concrete 235 may be poured in the space defined between the inner and outer corner walls, thus resulting in the formation of a concrete wall corner.

After this has been done, sheet rock, plywood or other material is placed against the sides of the mold and galvanized sheet rock screws are used to attach the material to the wall by going through the material and regions 215 and 217. The resulting structure is economical, has excellent insulated materials because the panels are made of a modified expanded polystyrene material.

In accordance with the invention and has been discovered that the use of corner braces on the bottom adjacent the ground is not necessary in view of the friction provided by the ground and the stability provided by the half crosspieces.

Figure 17:
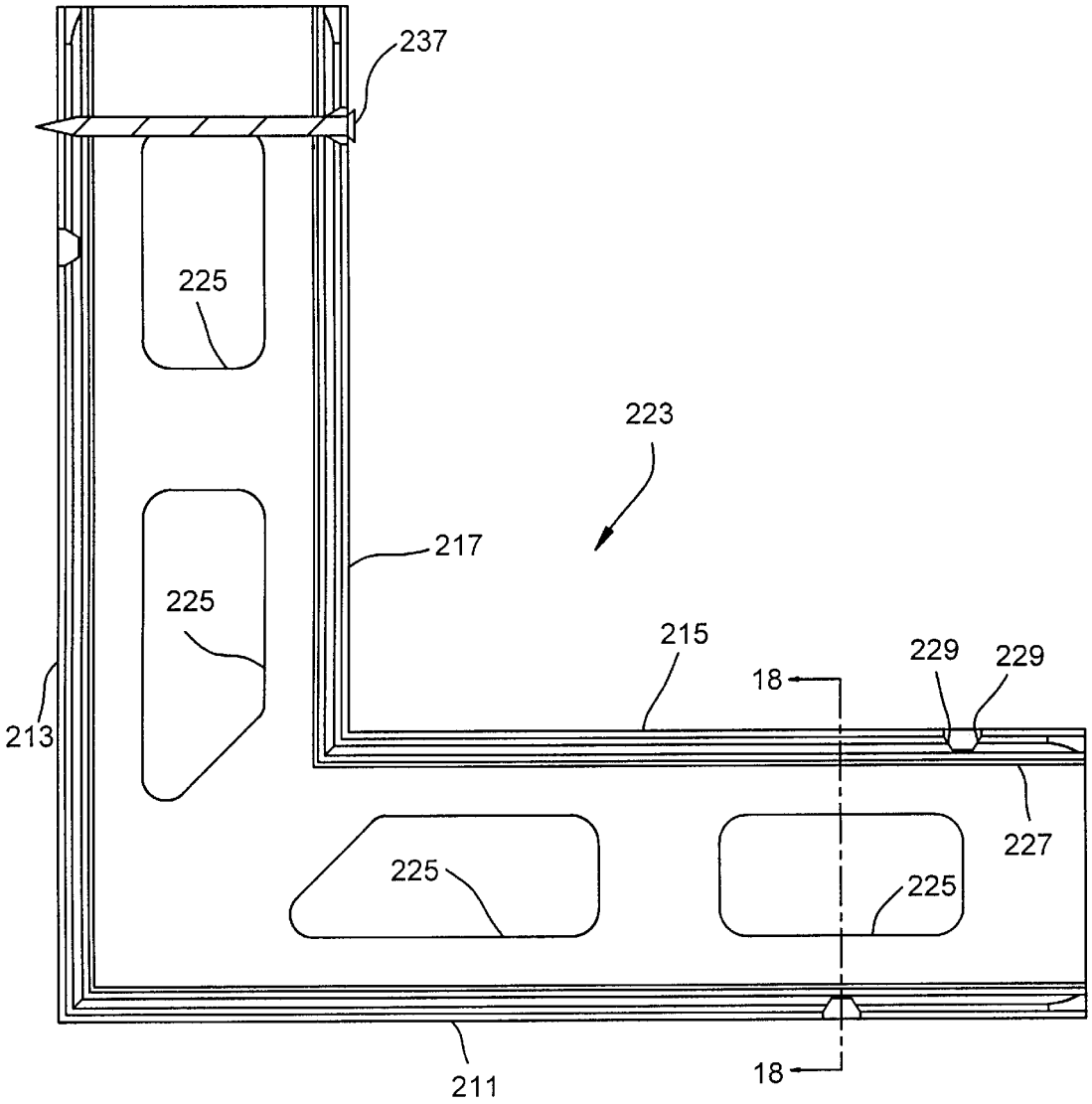
FIG. 17 is a top plan view of the inventive corner brace illustrated in FIG. 9 depicting a feature of the invention.
Figure 18:
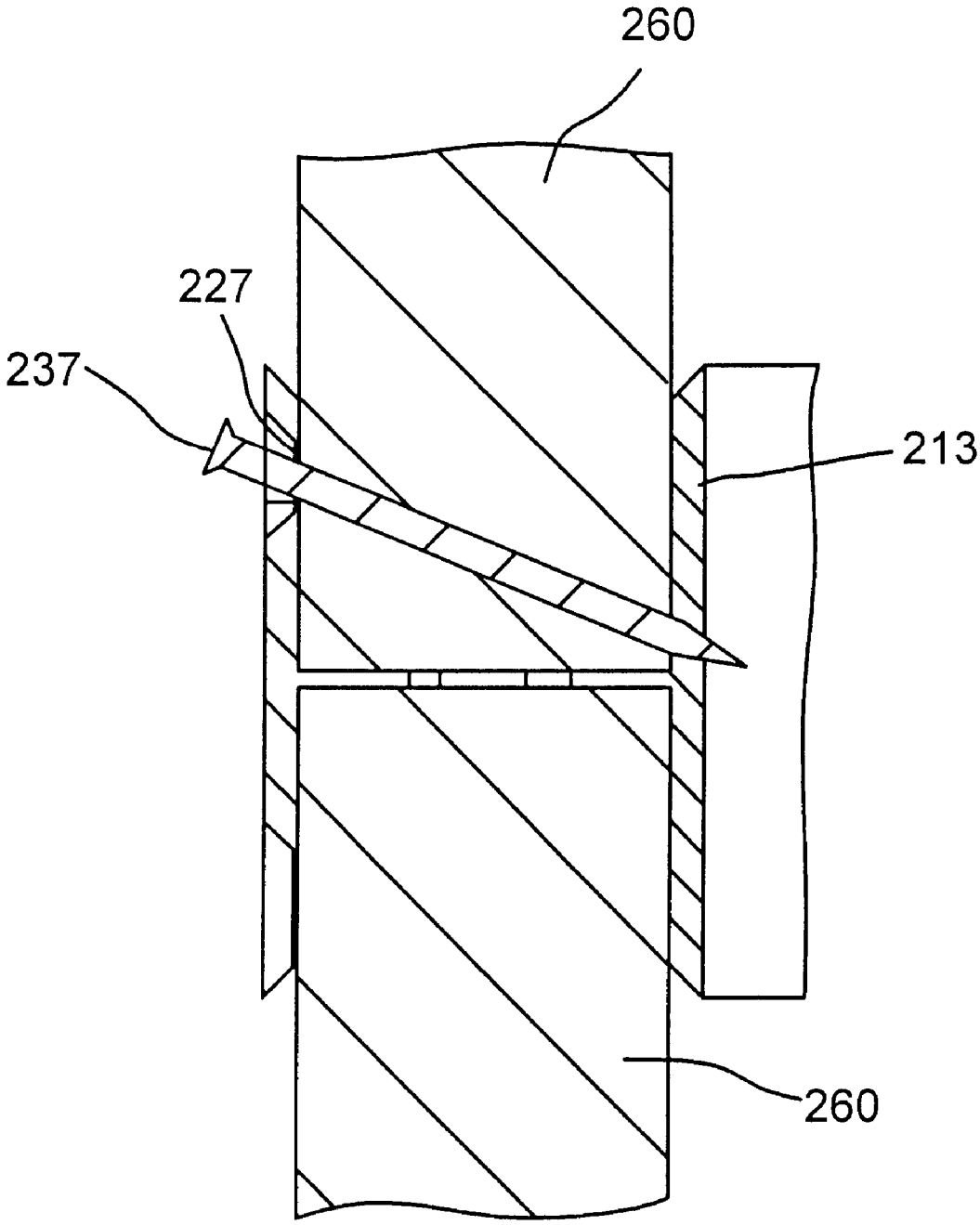
FIG. 18 is a cross-sectional view of the inventive corner brace illustrated in FIG. 9 depicting a feature of the invention.

FIGS. 17 and 18 illustrate another feature of the inventive corner brace. Elongated regions 227 and elongated surfaces 229 provide entrance points for screws that can be utilized quickly and allow screws to enter easily because they are thin, flexible and easily identified and pierced. As illustrated in FIG. 17, screw 237 passes through the thin elongated region 227 and the form panel 260, and enters side wall 213. Once screw 237 is through elongated region 227 and the form panel 260, screw 237 will enter side wall 213 requiring less effort than it would take to put screw 237 through side wall 213 by itself. Using this method to anchor screw 237 adds further strength to the system because of the thickness of the wall on the opposite side of the thin elongated region 227. Screw 237 may also be anchored in side wall 213 on a slant as illustrated in FIG. 18 to engage the thickest part of the opposite wall of the corner brace 210.

While illustrative embodiments of the invention have been described above, it is understood that various modifications may be made without departing from the spirit and scope of the invention, which is limited and defined only by the appended claims.

What is claimed is:

1. A concrete form brace, comprising:

(a) a first elongated section and a second elongated section, said first and second sections having planar members diverging from a common end, said first and second sections each having a separate distal end and a first and second side edge;

(b) a first pair of flange members on said first section for engaging form panels, said flange members diverging from the first and second side edges of the planar member of said first section;

(c) a second pair of flange members on said second section for engaging form panels, said flange members diverging from the first and second side edges of the planar member of said second section; and, (d) at least one thinned-out area on one of the flange members of the first and second pairs of flange members for receiving fasteners, said thinned-out area being parallel to an area of regular thickness on the other flange member of the pair for securing fasteners extended through the form panels; and, wherein the angle formed between the longitudinal axis of said first section and the longitudinal axis of said second section is a number greater than 0 and less than 180 degrees.

2. A concrete form brace as in claim 1, wherein said flange members are planar.

3. A concrete form brace as in claim 1, wherein said first section is perpendicular to said second section, said angle being 90 degrees.

4. A concrete form brace as in claim 1, wherein said flange members are made of material which will receive a screw.

5. A concrete form brace as in claim 1, wherein said first pair of flange members on said first section are integral with said second pair of flange members on said second section.

6. A concrete form brace as in claim 1, wherein the top and bottom edges of said flange members are chamfered.

7. A concrete form brace as in claim 1, wherein the brace is made of plastic.

8. A concrete form brace system, including at least one pair of panels intended to be maintained in an upright position, each panel having inner and outer faces and upper, lower and side edges in said upright position, said form brace comprising:

(a) a support member having two elongated sections, said two elongated sections being joined at and diverging from a first end of each section and terminating at respective second ends distal from the joined first ends, said elongated sections having intersecting longitudinal axes; and (b) a pair of panel-engaging members to grip and position the panels, the panel-engaging members of one pair being respectively engageable with the inner and outer faces of one of the panels and the panel-engaging members of the other pair being respectively engageable with the inner and outer faces of the other of the panels, said panel-engaging members further comprise a plurality of thinned-out areas for receiving a fastener; and wherein the longitudinal axes of the panels corresponds with the longitudinal axes of the two sections.

9. A concrete form brace as in claim 8, wherein said thinned-out areas are parallel to a thicker portion of said panel-engaging member, such that a fastener may extend through said thinned-out area and anchor into said thicker portion.

* * * * *